US007138755B2

(12) United States Patent
Iwasaki

(10) Patent No.: US 7,138,755 B2
(45) Date of Patent: Nov. 21, 2006

(54) COLOR PICTURE TUBE APPARATUS HAVING BEAM VELOCITY MODULATION COILS OVERLAPPING WITH CONVERGENCE AND PURITY UNIT AND RING SHAPED FERRITE CORE

(75) Inventor: Katsuyo Iwasaki, Nishinomiya (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 166 days.

(21) Appl. No.: 10/932,743

(22) Filed: Sep. 2, 2004

(65) Prior Publication Data

US 2005/0057694 A1 Mar. 17, 2005

(30) Foreign Application Priority Data

Sep. 12, 2003 (JP) ..... 2003-321662

(51) Int. Cl.
*H01J 29/70* (2006.01)
*H01J 29/58* (2006.01)
*H01F 1/00* (2006.01)

(52) U.S. Cl. ..... 313/440; 315/382.1; 335/212

(58) Field of Classification Search ..... 313/421, 313/440; 335/210–214, 296, 298; 315/3, 315/15, 381, 382, 382.1
See application file for complete search history.

(56) References Cited

U.S. PATENT DOCUMENTS 3,387,158 A 6/1968 Ohkoshi et al.
6,472,809 B1 * 10/2002 Motomiya et al. ..... 313/440
2004/0251835 A1 * 12/2004 Iwasaki et al. ..... 315/8

FOREIGN PATENT DOCUMENTS

| | | |
|---|---|---|
| EP | 0 484 606 A1 | 5/1992 |
| EP | 1 187 168 A1 | 3/2002 |
| EP | 1 460 673 A2 | 9/2004 |
| JP | 57-45650 | 10/1982 |
| JP | 6-283113 | 10/1994 |

* cited by examiner

*Primary Examiner*—Joseph Williams
*Assistant Examiner*—Bumsuk Won
(74) *Attorney, Agent, or Firm*—Hamre, Schumann, Mueller & Larson, P.C.

(57) ABSTRACT

A CPU for adjusting color purity and color displacement at the center of a screen is provided on an outer circumferential surface of a neck portion. BVM coils for modulating a scanning velocity in a horizontal direction of electron beams are provided at a position where they are overlapped with the CPU in a tube-axis direction. A ring-shaped ferrite core is provided at a position where it is overlapped with the BVM coils in the tube axis direction. Two surfaces vertical to a tube axis of the ring-shaped ferrite core are covered with resin layers. Because of this, the ring-shaped ferrite core can be prevented from being cracked.

7 Claims, 8 Drawing Sheets

COLOR PICTURE TUBE APPARATUS HAVING BEAM VELOCITY MODULATION COILS OVERLAPPING WITH CONVERGENCE AND PURITY UNIT AND RING SHAPED FERRITE CORE

BACKGROUND OF THE INVENTION

1. Field of the Invention

The present invention relates to a color picture tube apparatus.

2. Description of the Related Art

In order to correct an edge of a displayed image to enhance image quality, a method for modulating a horizontal scanning velocity of electron beams is known. According to this method, in general, a pair of auxiliary coils called beam velocity modulation (BVM) coils are provided at a neck portion of a picture tube so as to be integrated with a deflection yoke and a convergence and purity unit (CPU) (see JP57(1982)-45650Y).

The BVM coils improve a visible state between a dark area and a light area of an image displayed on a screen during a horizontal scanning period as follows. The transition of a lighting state is predicted from a video signal waveform. In a period on a dark side during a transition period of a lighting state, electron beams are accelerated so that they are horizontally scanned at a velocity equal to or higher than an average scanning velocity. On the other hand, in a period on a light side during the transition period of a lighting state, electron beams are decelerated so that they are horizontally scanned at a velocity equal to or lower than the average scanning velocity. Thus, among the areas of the transition of a lighting state on a screen, in an area on a dark side, an excitation time of phosphors is shortened to decrease brightness, and in an area on a light side, an excitation time of phosphors is prolonged to increase brightness. Accordingly, the edge of an image is corrected so as to increase the sharpness of the areas of the transition of lightness and darkness.

In the case where the above-mentioned BVM coils for modulating the horizontal scanning velocity of electron beams are provided so as to be integrated with the CPU, an eddy current is excited in an electron gun made of a metallic conductor due to the magnetic flux generated by the BVM coils, and the metallic conductor generates heat, resulting in a reduction in a velocity modulation effect by the BVM coils.

In order to enhance the sensitivity of the BVM coils, a method has been proposed for mounting a magnetic substance, which focuses and intensifies the magnetic field generated by the BVM coils, in the electron gun (see JP6(1994)-283113A).

However, the above-mentioned method has the following problems: since a magnetic substance for focusing a magnetic field is metal, a new eddy current is likely to be generated; a process for welding a new component is necessary, which increases a cost; and furthermore, sufficient sensitivity cannot be obtained.

Furthermore, it also is considered that, in order to decrease crosstalk between the magnetic field generated by the BVM coils and the electron gun metal to minimize the generation of an eddy current, the BVM coils are placed close to the end of a deflection yoke on the electron gun side. However, in this case, the BVM coils are placed close to a horizontal deflection coil, so that crosstalk between the magnetic field generated by the BVM coils and the horizontal deflection magnetic field is increased to cause new ringing. Therefore, there is a limit for placing the BVM coils close to the deflection yoke, and hence, a sufficient increase in sensitivity cannot be realized.

As one measure, as shown in FIG. 9A, a method has been worked out, for mounting a ring-shaped ferrite core 90 on an outer circumference of the BVM coils so that the ferrite core 90 is integrated with a CPU, thereby intensifying the magnetic flux generated by the BVM coils.

However, the ring-shaped ferrite core 90 simultaneously absorbs a vertical deflection magnetic field 92 generated by the deflection yoke 6, thereby weakening the vertical deflection magnetic field 92 on the side of a neck portion of the deflection yoke 6, as indicated by a broken line 94 in FIG. 9A (in FIG. 9A, a Z-axis indicates a tube axis of a color picture tube). Consequently, preliminary deflection of electron beams is decreased, and as shown in FIG. 9B, rasters 96 in the upper and lower portions of a screen are distorted as indicated by broken lines 98, causing image distortion. In order to reduce such raster distortion, it is preferable to make the ring-shaped ferrite core 90 as thin as possible (decrease the size thereof in a tube axis direction), and place it close to a cathode.

Thus, the configuration of placing the ring-shaped ferrite core 90 together with dipole, quadrupole, and hexapole magnet rings of the CPU has been considered.

In an assembly process of a color picture tube apparatus, the dipole, quadrupole, and hexapole magnet rings of the CPU are fixed so as to keep their positions (rotation positions around a tube axis) after adjusting convergence and purity. As a method for fixing the dipole, quadrupole, and hexapole magnet rings of the CPU, the following methods are known: a tightening fixing method for screwing with a lock ring; and an elastic fixing method for fixing by supplying an elastic compression force with an elastic ring having elasticity. In any of the methods, the dipole, quadrupole, and hexapole magnet rings of the CPU are fixed due to the compression force in the tube axis direction.

The ring-shaped ferrite core 90 has a twist and a wave in a thickness direction (tube axis direction) due to sintering in the course of production. Thus, in the case of fixing such ring-shaped ferrite core 90 together with the dipole, quadrupole, and hexapole magnet rings by the above-mentioned tightening fixing method, the ring-shaped ferrite core 90 will be cracked due to the compression force in the tube axis direction during tightening of a lock ring. Furthermore, even in the case of fixing the ring-shaped ferrite core 90 together with the dipole, quadrupole, and hexapole magnet rings by the above-mentioned elastic fixing method, the ring-shaped ferrite core 90 also will be cracked due to the elastic compression force in the tube axis direction and the external force caused by the vibration during transportation and the like. When the ring-shaped ferrite core 90 is cracked, the effect of intensifying the magnetic field of the BVM coils will be reduced.

SUMMARY OF THE INVENTION

The present invention solves the above-mentioned conventional problems, and its object is to provide a color picture tube apparatus with image quality enhanced, in which a ring-shaped ferrite core for intensifying the magnetic field of BVM coils, attached together with magnet rings of a CPU, is unlikely to be cracked.

A color picture tube apparatus of the present invention includes: a color picture tube having a panel with a phosphor screen formed on an inner surface thereof, a funnel connected to the panel, and an electron gun placed in a neck portion of the funnel; a deflection yoke provided on an outer circumferential surface of the funnel; a CPU for adjusting color purity and color displacement at a center of a screen, provided on an outer circumferential surface of the neck portion; BVM coils for modulating a scanning velocity in a horizontal direction of electron beams emitted from the electron gun, provided at a position where the BVM coils are overlapped with the CPU in a tube axis direction; and a ring-shaped ferrite core provided at a position where it is overlapped with the BVM coils in the tube-axis direction.

Two surfaces vertical to the tube axis of the ring-shaped ferrite core are covered with resin layers.

These and other advantages of the present invention will become apparent to those skilled in the art upon reading and understanding the following detailed description with reference to the accompanying figures.

DESCRIPTION OF THE PREFERRED EMBODIMENTS

According to the present invention, two surfaces vertical to a tube axis of a ring-shaped ferrite core are covered with resin layers, whereby the shape distortion of the ring-shaped ferrite core is eliminated, and the mechanical strength thereof is enhanced. Thus, even when the ring-shaped ferrite core is fixed together with magnet rings of a CPU by being provided with a compression force in a tube axis direction, the ring-shaped ferrite core will not be cracked.

Furthermore, the ring-shaped ferrite core is provided at a position where it is overlapped with BVM coils in the tube axis direction, so that the magnetic field generated by the BVM coils is intensified. Consequently, image quality is enhanced.

Embodiment 1

Figure 1:
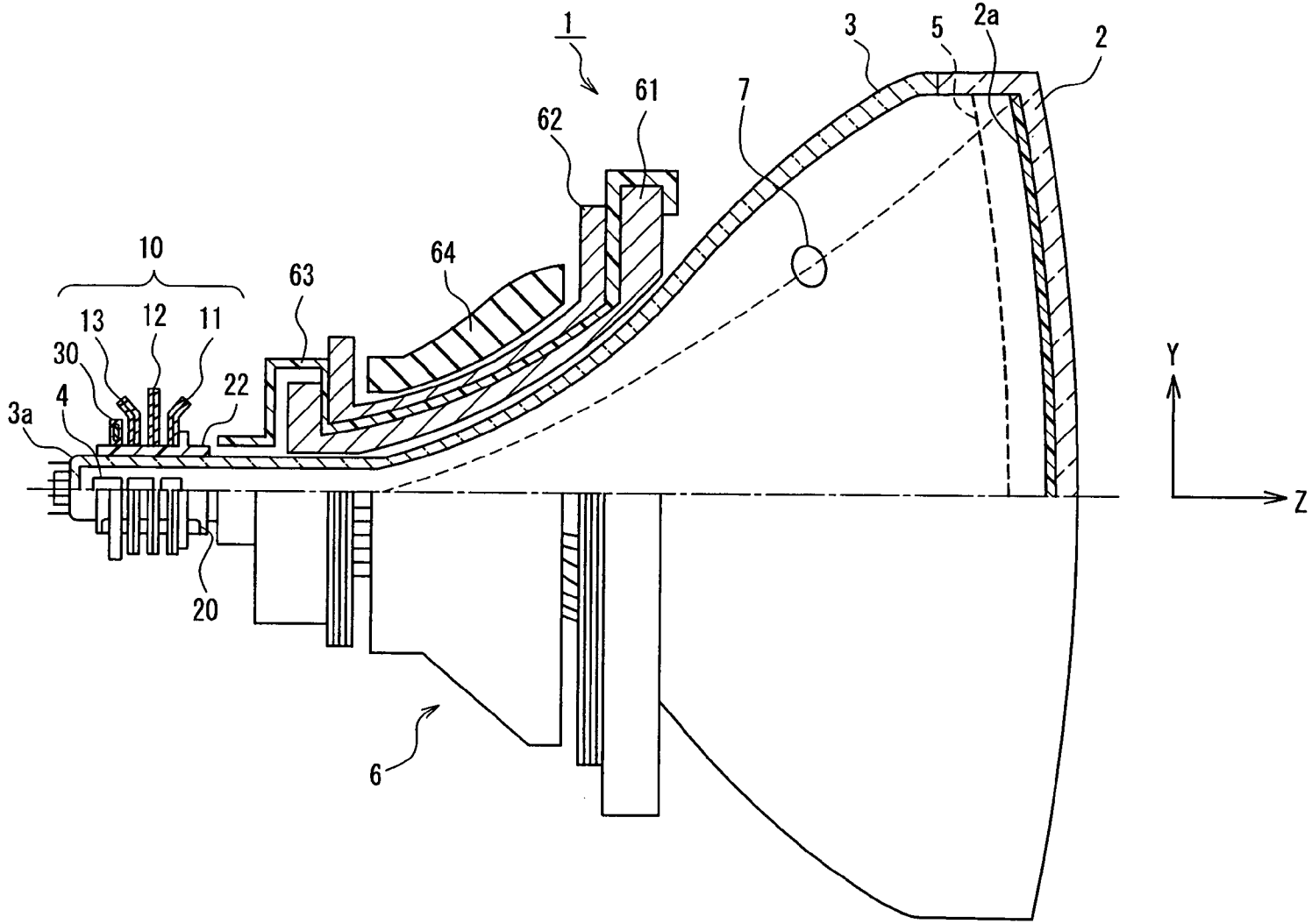
FIG. 1 is a view showing a schematic configuration of a color picture tube apparatus according to Embodiment 1 of the present invention.

FIG. 1 is a view showing a configuration of a color picture tube apparatus according to Embodiment 1 of the present invention. For convenience of the following description, it is assumed that a tube axis is a Z-axis, an axis in a horizontal direction (long side direction of a screen) is an X-axis, and an axis in a vertical direction (short side direction of a screen) is a Y-axis. The X-axis and the Y-axis cross each other on the Z-axis. In FIG. 1, a cross-sectional view and an outer appearance view are shown on an upper side and a lower side of the Z-axis, respectively.

A color picture tube (CRT) includes an envelope composed of a panel 2 and a funnel 3, and an electron gun 4 provided in a neck portion 3*a* of the funnel 3. A color picture tube apparatus 1 includes the color picture tube and a deflection yoke 6 mounted on an outer circumferential surface of the funnel 3. On an inner surface of the panel 2, a phosphor screen 2*a* is formed, in which respective phosphor dots (or phosphor stripes) of blue (B), green (G), and red (R) are arranged. A shadow mask 5 is attached to an inner wall surface of the panel 2 so as to be opposed to the phosphor screen 2*a*. The shadow mask 5 is made of a metallic plate with a number of substantially slot-shaped apertures, which are electron beam passage apertures, formed by etching, and three electron beams 7 (three electron beams are arranged in a line parallel to the X-axis, so that only one electron beam on the front side is shown in FIG. 1) emitted from the electron gun 4 pass through the apertures to strike predetermined phosphors. The deflection yoke 6 deflects the three electron beams 7 emitted from the electron gun 4 in vertical and horizontal directions to allow them to scan the phosphor screen 2*a*. The deflection yoke 6 includes a saddle-type horizontal deflection coil 61, a saddle-type vertical deflection coil 62, and a ferrite core 64. An insulating frame 63 made of resin is provided between the horizontal deflection coil 61 and the vertical deflection coil 62. The insulating frame 63 plays roles of maintaining electrical insulation between the horizontal deflection coil 61 and the vertical deflection coil 62, and supporting both deflection coils 61, 62.

Figure 2:
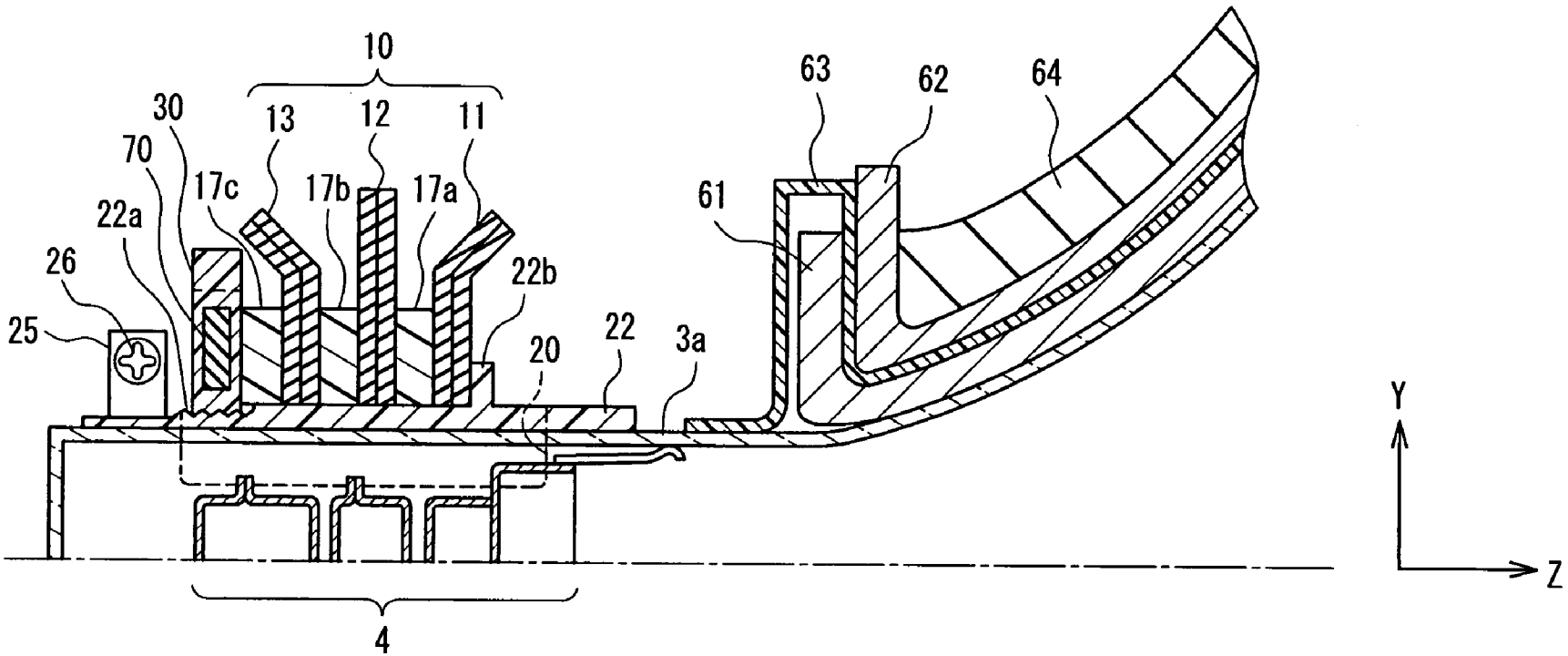
FIG. 2 is a partial cross-sectional view showing a configuration of a CPU circumference of the color picture tube apparatus according to Embodiment 1 of the present invention.

FIG. 2 is a partial cross-sectional view showing a circumferential configuration of the electron gun 4. In FIG. 2, reference numeral 10 denotes a convergence and purity unit (CPU), which adjusts static convergence and purity of electron beams at the center of a screen. The CPU 10 includes a dipole magnet ring 11, a quadrupole magnet ring 12, and a hexapole magnet ring 13. The respective dipole, quadrupole, and hexapole magnet rings 11, 12, and 13 are configured by stacking two annular magnets. Reference numeral 22 denotes a substantially cylindrical sleeve holding the respective dipole, quadrupole, and hexapole magnet rings 11, 12, and 13. A plurality of slits (cut portions) are formed in parallel with the Z-axis at an end of the sleeve 22 on the left side of the drawing surface, whereby the sleeve 22 is divided into a plurality of strips in a circumferential direction. The sleeve 22 is fitted around an outer circumference of the neck portion 3*a*, a substantially "Ω"-shaped metallic band 25 is mounted in the portions where the slits are formed, and both ends of the metallic band 25 are secured with a binding bolt 26, whereby the sleeve 22 is fixed onto the outer circumferential surface of the neck portion 3*a*.

Reference numeral 20 denotes a pair of beam velocity modulation (BVM) coils provided so as to be substantially symmetrical with respect to an XY-plane. Windings thereof are placed along the outer circumferential surface of the sleeve 22 to generate a magnetic field in a substantially Y-axis direction. The function of the BVM coils 20 is the same as that of the conventional example, so that the detailed description thereof will be omitted here.

Reference numeral 30 denotes a lock ring. An internal screw thread, which is engaged with an external screw thread 22*a* formed on the outer circumferential surface of the sleeve 22, is formed on an inner circumferential surface of the lock ring 30. The static convergence and purity are adjusted appropriately by adjusting the rotation angles around the Z-axis of the dipole magnet ring 11, the quadrupole magnet ring 12, and the hexapole magnet ring 13 constituting the CPU 10, and thereafter, the lock ring 30 is tightened. The respective magnet rings 11, 12, and 13 of the CPU 10 receive a compression force in the Z-axis direction to be fixed between the lock ring 30 and a flange 22*b* of the sleeve 22. More specifically, in the present embodiment, the respective dipole, quadrupole, and hexapole magnet rings 11, 12, and 13 are fixed by the tightening fixing method using the lock ring 30.

Reference numerals 17*a*, 17*b*, and 17*c* denote spacer rings made of resin that are placed between the dipole and quadrupole magnet rings 11 and 12, between the quadrupole and hexapole magnet rings 12 and 13, and between the hexapole magnet ring 13 and the lock ring 30, respectively. The spacer rings 17*a*, 17*b*, and 17*c* prevent the respective rotations around the Z-axis of the dipole magnet ring 11, the quadrupole magnet ring 12, the hexapole magnet ring 13, and the lock ring 30 from being transmitted to adjacent members.

Figure 3A:
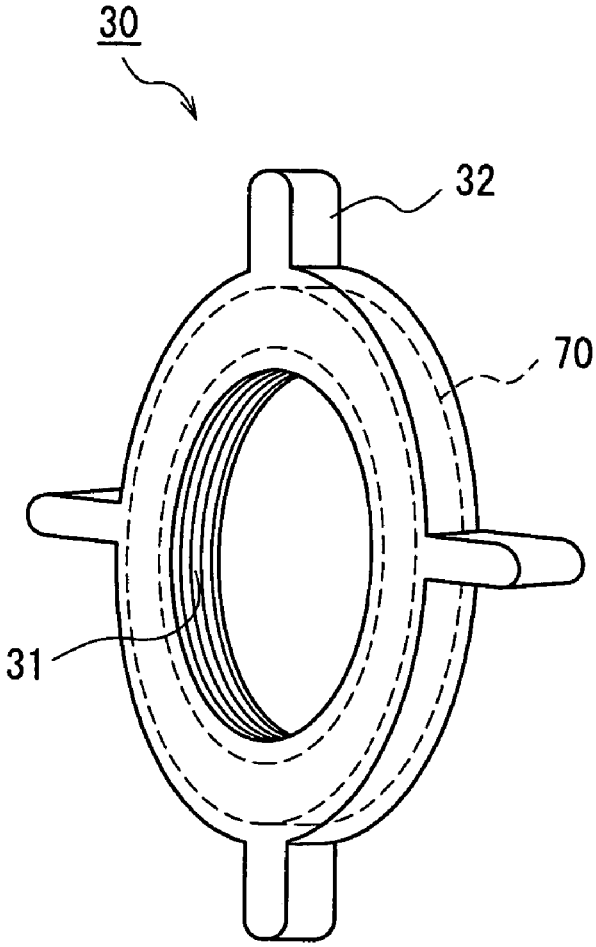
FIG. 3A is a perspective view of a lock ring of the color picture tube apparatus according to Embodiment 1 of the present invention.
Figure 3B:
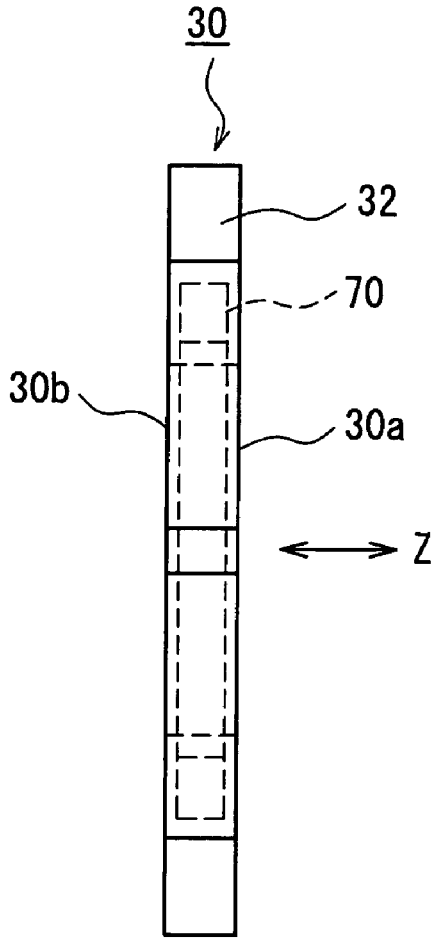
FIG. 3B is a side view thereof.

FIG. 3A is a perspective view showing an outer appearance of the lock ring 30, and FIG. 3B is a side view thereof. In the present embodiment, the lock ring 30 is molded of resin integrally with a ring-shaped ferrite core (hereinafter, referred to as a "ring core") 70 so as to cover the entire surface of the ring core 70 with resin. Reference numeral 31 denotes the internal screw thread formed on the inner circumferential surface of the lock ring 30, which is engaged with the external screw thread 22*a* of the sleeve 22. Reference numeral 32 denotes four projections formed at an equal angular spacing on an outer circumferential surface of the lock ring 30, which may be grabbed when the lock ring 30 is tightened to be fixed to the sleeve 22.

In one example, the thickness in the Z-axis direction of the lock ring 30 was set to be 4.5 mm, the inner diameter thereof was set to be 36 mm, and the outer diameter (excluding the projection 32) was set to be 48 mm. The thickness of the ring core 70 was set to be 2.5 mm, the inner diameter thereof was set to be 40 mm, and the outer diameter thereof was set to be 45 mm.

The ring core 70 is produced by molding ferrite powder in an annular shape, followed by sintering. During the sintering process, a twist and a wave in the thickness direction (Z-axis direction in FIG. 3B) are generated, whereby the flatness of two surfaces that are orthogonal to the Z-axis is degraded. In the present embodiment, the lock ring 30 integrated with the ring core is used, which is subjected to resin molding so as to cover the entire surface of the ring core 70. The twist and wave of the two surfaces orthogonal to the Z-axis of the ring core 70 are absorbed by resin layers 30*a*, 30*b* covering the two surfaces. The surfaces of the resin layers 30*a*, 30*b* having satisfactory flatness and parallelism are obtained easily by general resin molding. Furthermore, the mechanical strength of the lock ring 30 is enhanced, compared with the single ring core 70. Thus, even when the lock ring 30 integrated with the ring core is used as a lock ring for fixing the magnet rings 11, 12, and 13, there is no problem that the ring core 70 buried in the lock ring 30 is cracked during tightening of the lock ring 30.

Furthermore, the position on the Z-axis at which the lock ring 30 is mounted is overlapped with a range on the Z-axis in which the BVM coils 20 are present. Therefore, the magnetic field generated by the BVM coils 20 is intensified by the ring core 70, whereby the image quality is enhanced. In one example, it was confirmed that the magnetic field of the BVM coils 20 can be intensified by about 1.5 times, compared with the case of not using the ring core 70.

Figure 9A:
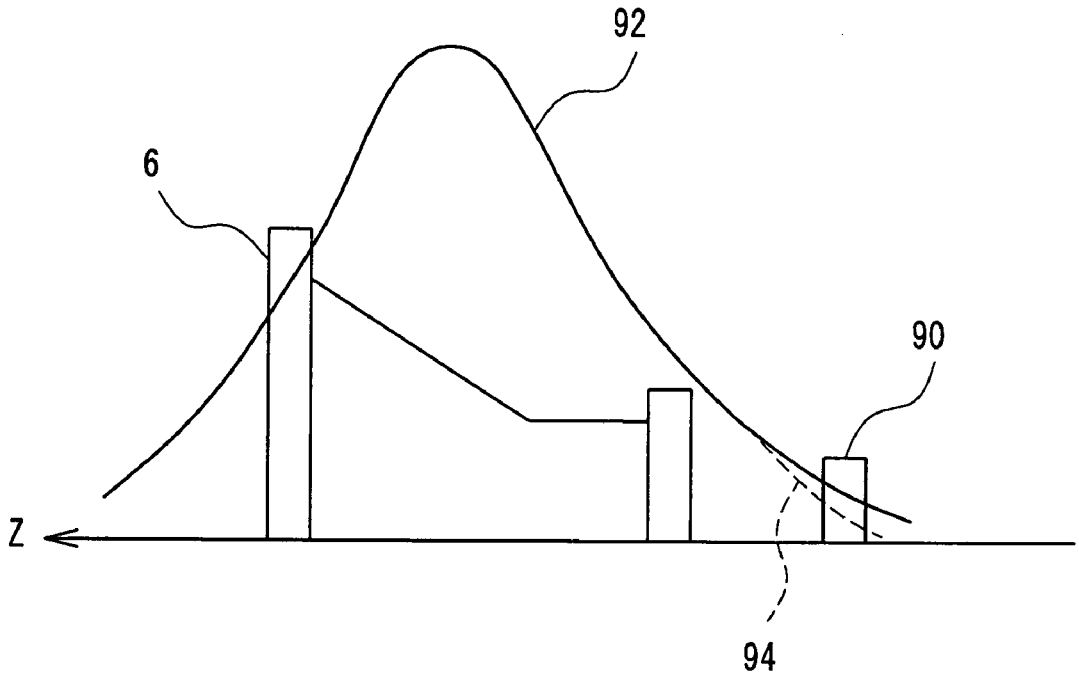
FIG. 9A PRIOR ART
FIG. 9A is a vertical deflection magnetic field distribution diagram in a tube axis direction showing a state where a ring-shaped ferrite core absorbs and weakens a vertical deflection magnetic field.
Figure 9B:
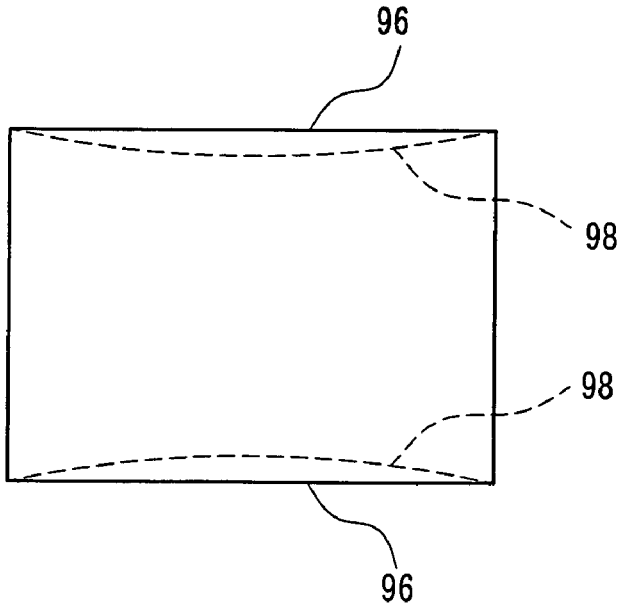
FIG. 9B PRIOR ART
FIG. 9B is a view showing raster distortion generated by the ring-shaped ferrite core.

Furthermore, the ring core 70 is integrated with the lock ring 30 placed at a position farther away from the deflection yoke 6, compared with the magnet rings 11, 12, and 13 constituting the CPU 10. Therefore, the tendency of the ring core 70 to absorb the vertical deflection magnetic field generated by the vertical deflection coil 62 is reduced. Consequently, the raster distortion (broken lines 98 in FIG. 9B) in upper and lower portions of a screen can be reduced.

Figure 4A:
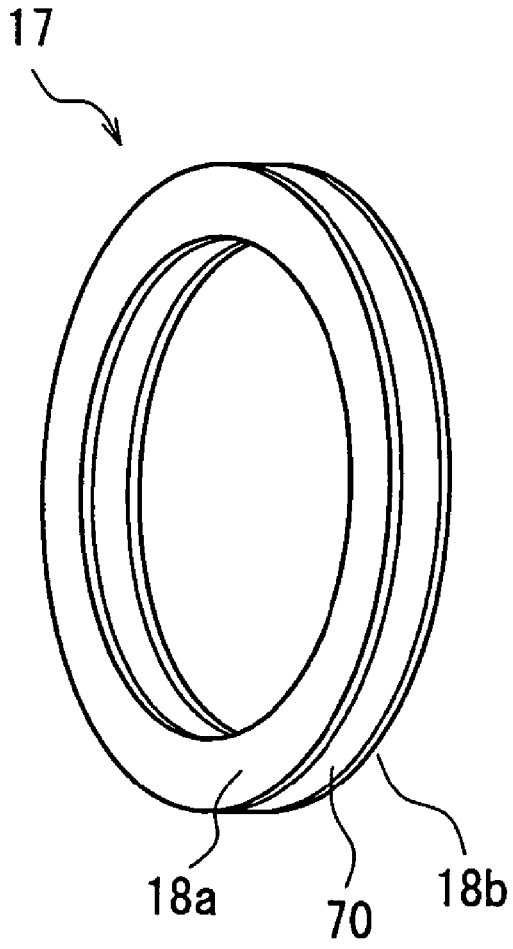
FIG. 4A is a perspective view of a spacer ring of the color picture tube apparatus according to Embodiment 1 of the present invention.
Figure 4B:
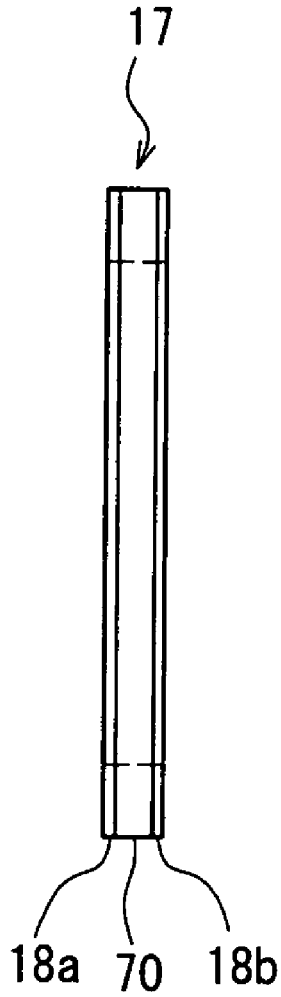
FIG. 4B is a side view thereof.

In the above-mentioned embodiment, the case has been described where the CPU 10 is fixed with the lock ring 30 molded of resin integrally with the ring core 70. However, the present invention is not limited thereto. For example, at least one of the spacer rings 17*a*, 17*b*, and 17*c* may be replaced with a spacer ring 17 molded of resin integrally with the ring core 70 shown in FIGS. 4A and 4B. FIG. 4A is a perspective view of the spacer ring 17, and FIG. 4B is a side view thereof In this case, the two surfaces orthogonal to the Z-axis of the ring core 70 only need to be covered at least with the resin layers 18*a*, 18*b*. The twist and wave of the two surfaces of the ring core 70 are absorbed by the resin layers 18*a*, 18*b*. The surfaces of the resin layers 18*a*, 18*b* having satisfactory flatness and parallelism are obtained easily by general resin molding. Furthermore, in the spacer ring 17 with the resin layers 18*a*, 18*b* formed thereon, the mechanical strength is enhanced compared with the single ring core 70. Thus, even when the spacer ring 17 is tightened with the lock ring, the ring core 70 will not be cracked. Furthermore, by placing the spacer ring 17 molded of resin integrally with the ring core 70 so that the position thereof on the Z-axis is overlapped with that of the BVM coils 20, the magnetic field generated by the BVM coils 20 is intensified by the ring core 70, whereby image quality is enhanced. The lock ring used together with the spacer ring 17 may be the lock ring 30 molded of resin integrally with the ring core 70 shown in FIGS. 3A and 3B, or may be a conventional lock ring not including the ring core 70.

The thickness (size in the Z-axis direction) of the ring core 70 of about 2 to 3 mm is sufficient. Thus, by replacing the lock ring or at least one of the spacer rings 17*a*, 17*b*, 17*c*, with the one molded of resin integrally with the ring core 70, the magnetic field generated by the BVM coils 20 can be intensified without increasing the size in the Z-axis direction of the CPU 10.

Embodiment 2

In Embodiment 1, the example has been described, where the present invention is applied to a color picture tube apparatus with a CPU mounted thereon, in which the dipole, quadrupole, and hexapole magnet rings 11, 12, and 13 are fixed with the screw thread tightening force of the lock ring. In Embodiment 2, an example will be described, where the present invention is applied to a color picture tube apparatus with a CPU mounted thereon, in which the dipole, quadrupole, and hexapole magnet rings 11, 12, and 13 are fixed with the elastic force of an elastic ring.

The color picture tube apparatus of Embodiment 2 is the same as the color picture tube apparatus 1 of Embodiment 1 shown in FIG. 1, except for the circumferential configuration of the CPU 10. In the following description, the same components as those in Embodiment 1 are denoted with the same reference numerals as those therein, and the detailed description thereof will be omitted here.

Figure 5:
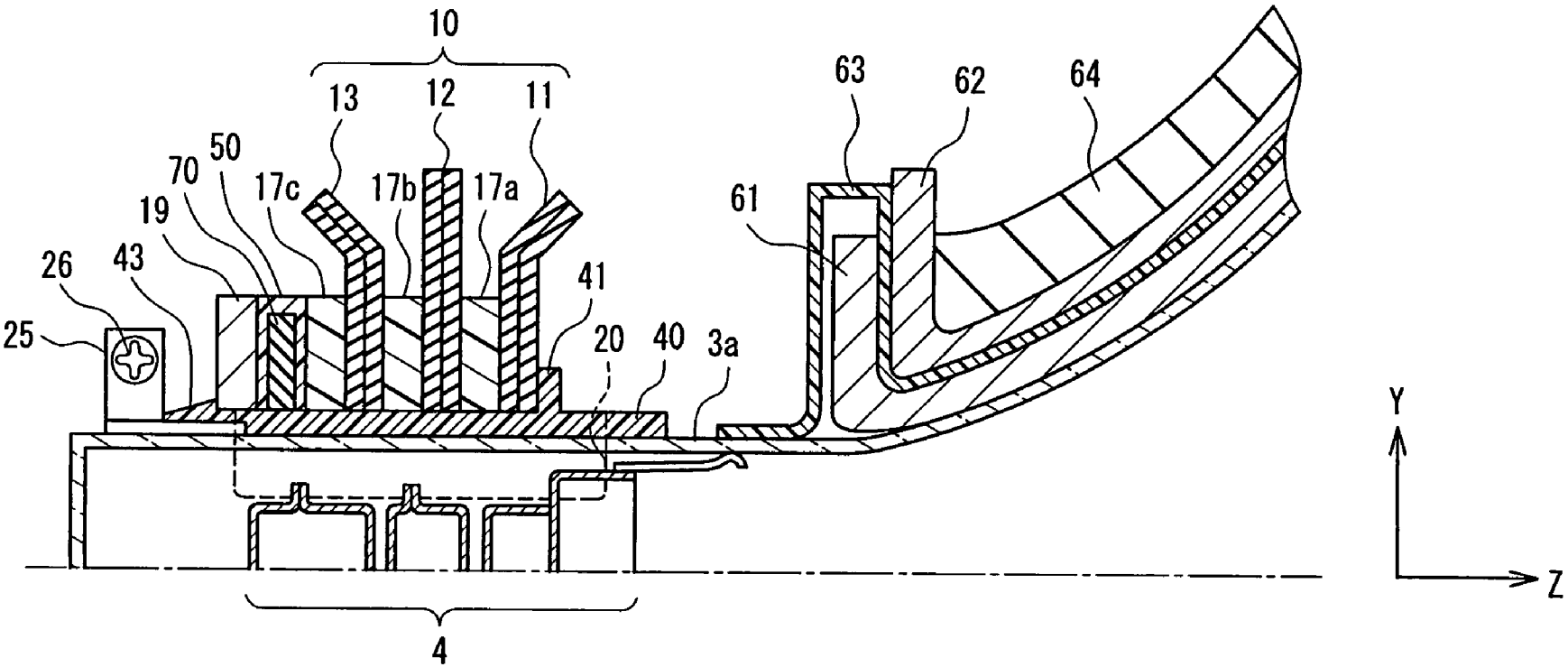
FIG. 5 is a partial cross-sectional view showing a configuration of a CPU circumference of a color picture tube apparatus according to Embodiment 2 of the present invention.

FIG. 5 is a partial cross-sectional view showing a circumferential configuration of the electron gun 4. In the present embodiment, the respective dipole, quadrupole, and hexapole magnet rings 11, 12, and 13 constituting the CPU 10 are held by a sleeve 40 in a substantially cylindrical shape.

Figure 6:
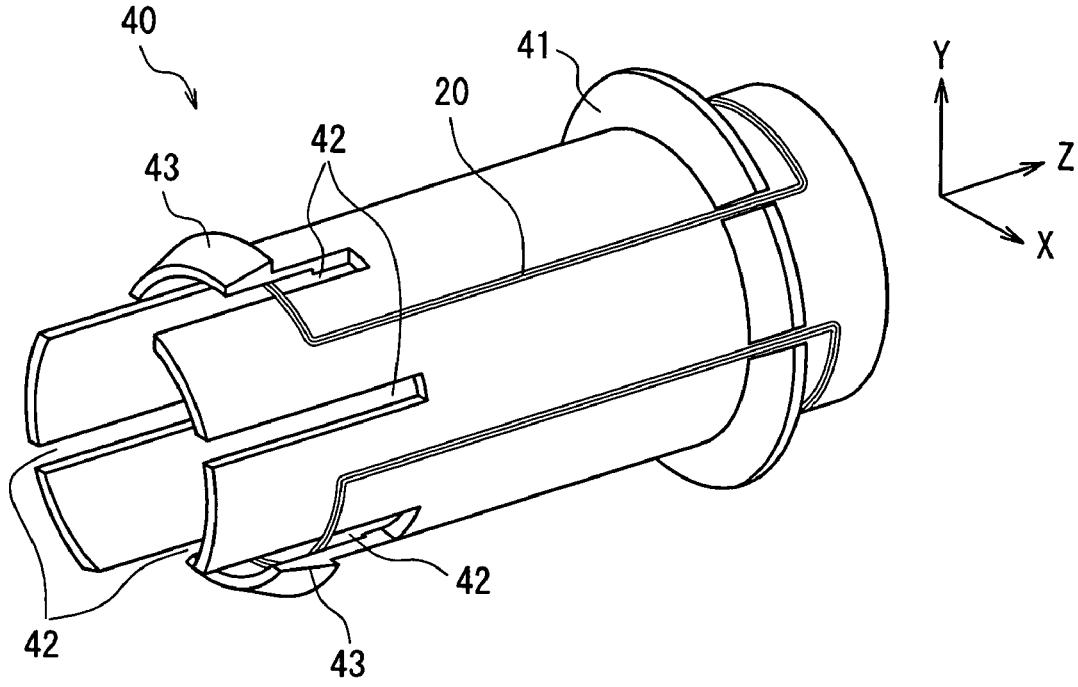
FIG. 6 is a schematic perspective view showing a sleeve of the color picture tube apparatus according to Embodiment 2 of the present invention.

FIG. 6 is a schematic perspective view of the sleeve 40. A flange 41 is formed at one end of the sleeve 40, and a plurality of slits (cut portions) 42 are formed in parallel with the Z-axis at the other end of the sleeve 40, whereby the sleeve 40 is divided into a plurality of strips in a circumferential direction. In parts of the plurality of strips, engagement hooks 43 with an outer circumferential surface tilted in a taper shape are formed.

As shown in FIG. 5, the dipole magnet ring 11, the spacer ring 17*a*, the quadrupole magnet ring 12, the spacer ring 17*b*, the hexapole magnet ring 13, the spacer ring 17*c*, an elastic ring 50, and a stopper ring 19 are fitted successively in this order from the flange 41 side around an outer circumferential surface of the sleeve 40. The sleeve 40 is fitted around an outer circumference of the neck portion 3*a*, and the substantially "Ω"-shaped metallic band 25 is mounted on the portions where the slits 42 are formed, and both ends of the metallic band 25 are secured with the binding bolt 26, whereby the sleeve 40 is fixed onto the outer circumferential surface of the neck portion 3*a*.

Figure 7A:
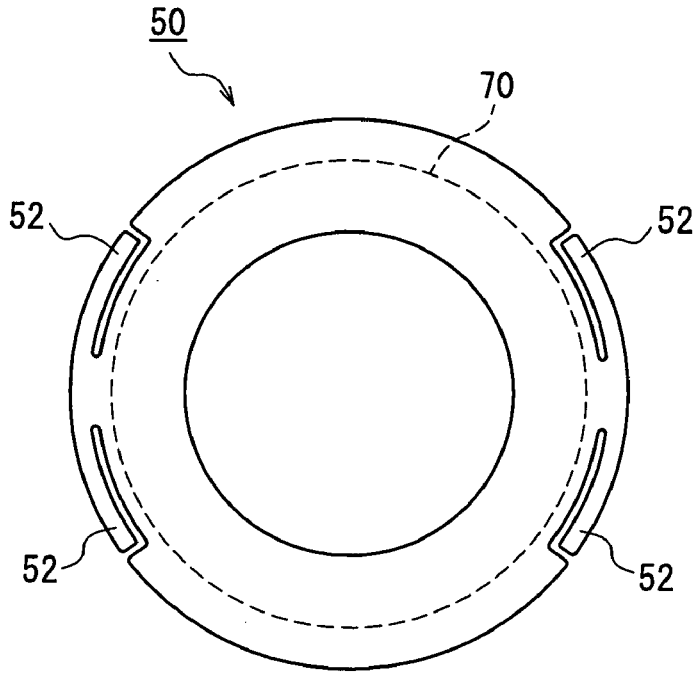
FIG. 7A is a perspective view of an elastic ring of the color picture tube apparatus according to Embodiment 2 of the present invention.
Figure 7B:
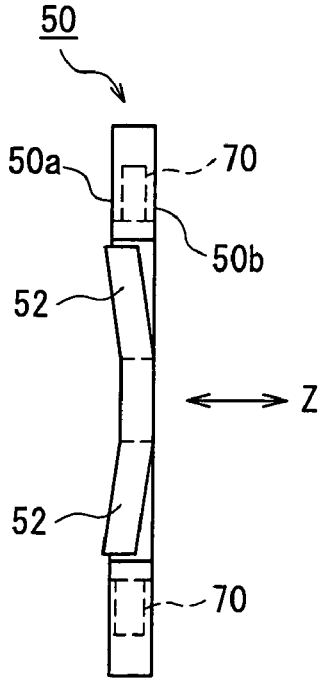
FIG. 7B is a side view thereof.

FIG. 7A is a front view of the elastic ring 50, and FIG. 7B is a side view thereof. A pair of shaped portions are formed on an outer circumferential edge of the elastic ring 50. Each T-shaped portion includes a pair of cantilevered arms 52. The free end of each arm 52 is displaced to one side in the Z-axis direction.

By adjusting the rotation angles around the Z-axis of the dipole magnet ring 11, the quadrupole magnet ring 12, and the hexapole magnet ring 13 constituting the CPU 10 under the condition that the stopper ring 19 is placed on the side of the metallic band 25 with respect to the engagement hooks 43, the static convergence and purity are adjusted appropriately. Thereafter, the stopper ring 19 is moved toward the dipole, quadrupole, and hexapole magnet rings 11, 12, and 13. After the inner circumferential surface of the stopper ring 19 elastically displaces the engagement hooks 43 of the sleeve 40 on the Z-axis side, and the engagement hooks 43 are engaged with an inner circumferential edge of the stopper ring 19, whereby the stopper ring 19 is fixed to the sleeve 40. At this time, the arms 52 of the elastic ring 50 are deformed elastically in the Z-axis direction. Thus, the respective magnet rings 11, 12, and 13 of the CPU 10 receive a compression force in the Z-axis direction based on the elastic restoring force of the arms 52 to be fixed between the stopper ring 19 and the flange 41 of the sleeve 40. That is, in the present embodiment, the respective dipole, quadrupole, and hexapole magnet rings 11, 12, and 13 are fixed by the elastic fixing method using the elastic ring 50.

Herein, as shown in FIGS. 7A and 7B, the elastic ring 50 is molded of resin integrally with the ring core 70 so that the surface of the ring core 70 excluding an inner circumferential surface is covered with resin. Thus, even when two surfaces orthogonal to the Z-axis of the ring core 70 have a twist and a wave in the thickness direction (Z-axis direction of FIG. 7B), resin layers 50*a*, 50*b* covering these two surfaces absorb them. The surfaces of the resin layers 50*a*, 50*b* having satisfactory flatness and parallelism are obtained easily by general resin molding. Furthermore, the elastic ring 50 has mechanical strength enhanced compared with the single ring core 70. Thus, even when the elastic ring 50 integrated with the ring core is used as an elastic ring for fixing the magnet rings 11, 12, and 13, the ring core 70 will not be cracked due to the compression force in the Z-axis direction, the vibration from outside during transportation, and the like. The inner circumferential surface of the ring core 70 also may be covered with resin.

In one example, the thickness (excluding the projection due to the arm 52) in the Z-axis direction of the elastic ring 50 was set to be 4.5 mm, the inner diameter thereof was set to be 36 mm, and the outer diameter thereof was set to be 48 mm. The thickness of the ring core 70 was set to be 2.5 mm, the inner diameter thereof was set to be 36 mm, and the outer diameter thereof was set to be 41 mm.

Furthermore, the position on the Z-axis at which the elastic ring 50 is mounted is overlapped with a range on the Z-axis in which the BVM coils 20 are present. Therefore, the magnetic field generated by the BVM coils 20 is intensified by the ring core 70, whereby image quality is enhanced. In one example, it was confirmed that the magnetic field of the BVM coils 20 can be intensified by about 1.5 times, compared with the case of not using the ring core 70.

The arrangement order of the elastic ring 50 in the Z-axis direction is not limited to the example in FIG. 5; however, as shown in FIG. 5, when the elastic ring 50 is placed farther away from the deflection yoke 6, compared with the magnet rings 11, 12, and 13 constituting the CPU 510, the tendency of the ring core 70 to absorb the vertical deflection magnetic field generated by the vertical deflection coil 62 is reduced. Consequently, the raster distortion (broken lines 98 in FIG. 9B) in upper and lower portions on a screen can be reduced.

The stopper ring 19 may be omitted by allowing the elastic ring 50 to function also as the stopper ring 19. In this case, the size of the CPU 10 in the Z-axis direction can be reduced.

At least one of the spacer rings 17*a*, 17*b*, and 17*c* also can be replaced with the elastic ring 50 integrated with the ring core shown in FIGS. 7A and 7B. In this case, the replaced spacer ring can be omitted, so that the size in the Z-axis direction of the CPU 10 can be reduced.

Furthermore, at least one of the spacer rings 17*a*, 17*b*, and 17*c* may be replaced with the spacer ring 17 molded of resin integrally with the ring core 70 shown in FIGS. 4A and 4B. In this case, the same effects as those described in Embodiment 1 can be obtained. Furthermore, the stopper ring 19 may be replaced with the one molded of resin integrally with the ring core 70. In any case, the elastic ring 50 may be the elastic ring 50 molded of resin integrally with the ring core 70 shown in FIGS. 7A and 7B, or may be a conventional elastic ring not including the ring core 70.

The thickness (size in the Z-axis direction) of the ring core 70 of about 2 to 3 mm is sufficient. Thus, by replacing at least one of the elastic ring, the spacer rings 17*a*, 17*b*, 17*c*, and the stopper ring 19, with the one molded of resin integrally with the ring core 70, the magnetic field generated by the BVM coils 20 can be intensified without increasing the size in the Z-axis direction of the CPU 10.

Embodiment 3

In Embodiments 1 and 2, the example has been described in which, due to the resin molding integral with the ring core 70, the two surfaces orthogonal to the Z-axis of the ring core 70 are covered with resin layers. However, the present invention is not limited thereto. For example, the two surfaces orthogonal to the Z-axis of the ring core 70 may be covered with resin layers by placing the ring core 70 in a housing previously obtained by resin molding.

Figure 8A:
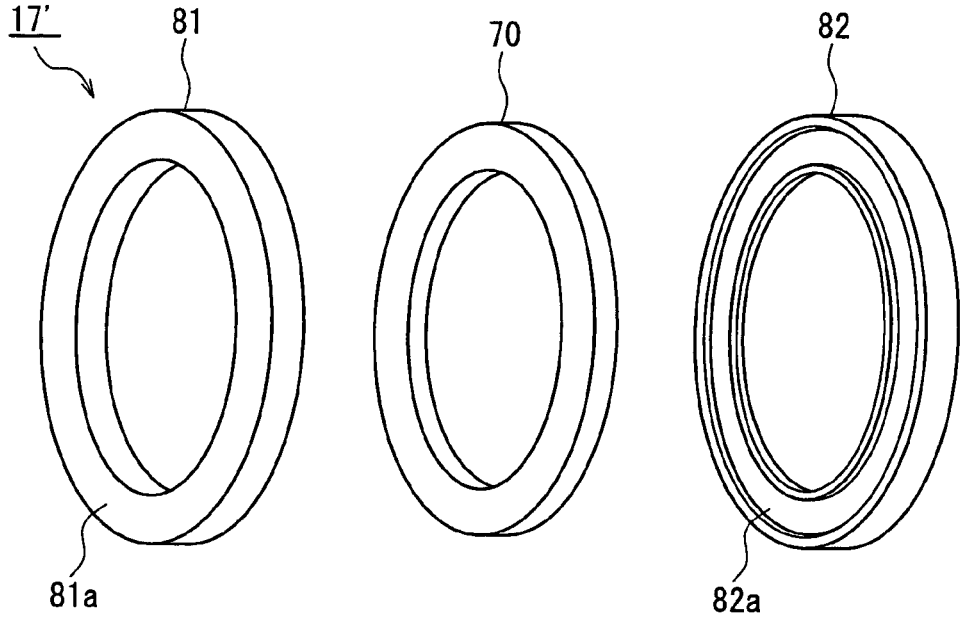
FIG. 8A is a exploded perspective view of a spacer ring of a color picture tube apparatus according to Embodiment 3 of the present invention.
Figure 8B:
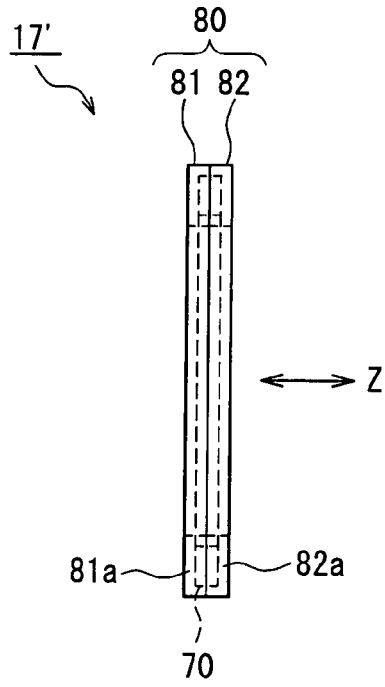
FIG. 8B is a side view thereof

FIG. 8A is an exploded perspective view of a spacer ring 17' according to Embodiment 3, and FIG. 8B is a side view thereof. The spacer ring 17' is composed of a ring core 70 and a housing 80 accommodating the ring core 70. The housing 80 is composed of a first member 81 and a second member 82 that are molded of resin. The ring core 70 is placed in a space formed by combining the first member 81 with the second member 82. At least one of the spacer rings 17*a*, 17*b*, and 17*c* shown in Embodiments 1 and 2 can be replaced with the spacer ring 17'.

Even in the present embodiment, the two surfaces orthogonal to the Z-axis of the ring core 70 are covered with resin layers 81*a*, 82*a* of the first and second members 81, 82. Outer surfaces of the resin layers 81*a*, 82*a* having satisfactory flatness and parallelism are obtained easily by general resin molding. Furthermore, the mechanical strength of the spacer ring 17' with the ring core 70 placed in the housing 80 including the resin layers 81*a*, 82*a* is enhanced, compared with the single ring core 70. Thus, even when a compression force in the Z-axis direction is applied to the spacer ring 17' by the tightening fixing method of Embodiment 1 and the elastic fixing method of Embodiment 2, the ring core 70 will not be cracked.

In FIGS. 8A and 8B, the housing 80 covers the entire outer surface of the ring core 70. However, the housing 80 only need to be provided at least with the resin layers 81*a*, 82*a* covering the two surfaces orthogonal to the Z-axis of the ring core 70. For example, the housing 80 may expose the inner circumferential surface and/or the outer circumferential surface of the ring core 70. Furthermore, as long as the two surfaces orthogonal to the Z-axis of the ring core 70 are substantially covered with the resin layers 81*a*, 82*a* to such a degree that the ring core 70 can be prevented from being cracked due to an external force, an opening for exposing the ring core 70 may be formed in a part of the resin layers 81*a*, 82*a*.

In FIGS. 8A and 8B, the example has been described in which the ring core 70 placed in the housing is used as at least one of the spacer rings 17*a*, 17*b*, and 17*c*. The present invention is not limited thereto. For example, at least one of the lock ring 30, the elastic ring 50, and the stopper ring 19 may be replaced with the ring core 70 placed in the housing.

In Embodiments 1, 2, and 3, the deflection yoke 6 and the CPU 10 are separated. However, even in the case where both the deflection yoke 6 and the CPU 10 are integrated (e.g., the insulating frame 62 and the sleeve 22 or 40 are integrated) with each other, the present invention can be applied, and the same effects as those in the above can be obtained.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color picture tube apparatus, comprising:

a color picture tube having a panel with a phosphor screen formed on an inner surface thereof, a funnel connected to the panel, and an electron gun placed in a neck portion of the funnel;

a deflection yoke provided on an outer circumferential surface of the funnel;

a convergence and purity unit (CPU) for adjusting color purity and color displacement at a center of a screen, provided on an outer circumferential surface of the neck portion;

beam velocity modulation (BVM) coils for modulating a scanning velocity in a horizontal direction of electron beams emitted from the electron gun, provided at a position where the BVM coils are overlapped with the CPU in a tube axis direction; and a ring-shaped ferrite core provided at a position where it is overlapped with the BVM coils in the tube-axis direction, wherein two surfaces vertical to the tube axis of the ring-shaped ferrite core are covered with resin layers.

2. The color picture tube apparatus according to claim 1, wherein the CPU includes a plurality of pairs of magnet rings and a lock ring for fixing the magnet rings, and the lock ring includes the ring-shaped ferrite core.

3. The color picture tube apparatus according to claim 1, wherein the CPU includes a plurality of pairs of magnet rings and an elastic ring for providing the magnet rings with an elastic compression force in the tube axis direction to fix the magnet rings, and the elastic ring includes the ring-shaped ferrite core.

4. The color picture tube apparatus according to claim 1, wherein the CPU includes a plurality of pairs of magnet rings and spacer rings placed between the magnet rings, and at least one of the spacer rings includes the ring-shaped ferrite core.

5. The color picture tube apparatus according to claim 1, wherein the ring-shaped ferrite core and the resin layers are integrated with each other by resin molding.

6. The color picture tube apparatus according to claim 1, wherein the ring-shaped ferrite core is placed in a housing including the resin layers.

7. The color picture tube apparatus according to claim 1, wherein the ring-shaped ferrite core is placed at a position farther away from the deflection yoke, compared with magnet rings constituting the CPU.

* * * * *